United States Patent [19]

Kato

[11] 4,154,433

[45] May 15, 1979

[54] CONTINUOUS ATMOSPHERE CONTROLLED FURNACES

[75] Inventor: Yoshio Kato, Nagoya, Japan

[73] Assignees: Daidotokushuko Kabushiki Kaisha; Kabushiki Kaisha Kobeseikosho, both of Aichi, Japan

[21] Appl. No.: 806,203

[22] Filed: Jun. 13, 1977

[30] Foreign Application Priority Data

Jun. 17, 1976 [JP] Japan ..... 51-71448

[51] Int. Cl.[2] ..... C21D 1/74; F27B 5/04; F27B 5/16

[52] U.S. Cl. ..... 266/255; 266/251; 432/138; 432/198; 432/199; 432/208

[58] Field of Search ..... 266/44, 249, 251, 252, 266/253, 255, 258; 432/138, 198, 199, 200, 206, 208

[56] References Cited

U.S. PATENT DOCUMENTS

| | | | |
|---|---|---|---|
| 996,936 | 7/1911 | Massey | 137/625.11 X |
| 1,903,909 | 4/1933 | Cope et al. | 266/255 X |
| 2,486,506 | 11/1949 | Sylvester | 432/206 X |
| 2,754,104 | 7/1956 | Hess | 266/252 X |

*Primary Examiner*—Howard N. Goldberg
*Assistant Examiner*—Paul A. Bell
*Attorney, Agent, or Firm*—William Anthony Drucker

[57] ABSTRACT

Disclosed is a continuous atmosphere controlled furnace for aluminum brazing and other purposes. A plurality of pots are suspended from a circular roof rotatable in a horizontal plane and arranged in a circle having a center on the axis of rotation of the roof. Each pot comprises a body having an open top and a cover capable of closing the open top of the body. The open top of each pot projects above the roof and that portion of each pot which contains the material to be heated extends downwardly below the roof. The material to be heated is supported on a hanger depending from the cover of each pot and the cover is lowered to place the material in the pot and close the pot. The furnace further includes an atmosphere gas distributor having its center on the axis of rotation of the roof and connected to the pots by gas supply and exhaust ducts. A method of supplying atmosphere gas through the pots is also described.

9 Claims, 11 Drawing Figures

CONTINUOUS ATMOSPHERE CONTROLLED FURNACES

This invention relates to a continuous atmosphere controlled furnace particularly for use in the brazing of aluminum and the heat treatment of stainless steel, brass or the like and a method of introducing atmosphere gas into such a furnace.

It is preferable to keep oxidizing gas, such as $O_2$, $H_2O$ and $CO_2$, at a minimum in a furnace for brazing aluminum or heat treating stainless steel, brass and the like. This is particularly the case with the brazing of aluminum, for which the oxidizing gas content of a brazing furnace must be kept as little as possible. For this purpose, mesh belt conveyor furnaces, tray pusher furnaces, roller hearth furnaces or the like have hitherto been used. But none of these furnaces have been satisfactory for applications in which it is necessary to keep oxidizing gases in a furnace at a minimum, since air leaks into the furnace through its entrance and exit and oxidizing gas comes up out of furnace refractories.

It is an object of this invention to provide a high capacity continuous atmosphere controlled furnace for use in the brazing of aluminum and the heat treatment of stainless steel, brass or the like.

It is another object of this invention to provide a continuous atmosphere controlled furnace in which the aforementioned heat treatment can be accomplished efficiently by moving round a relatively small number of enclosed pots.

It is still another object of this invention to provide a continuous atmosphere controlled furnace having a plurality of enclosed pots which are easy to charge and discharge through their top.

It is a further object of this invention to provide a continuous atmosphere controlled furnace in which neither any enclosed pot nor its cover is subjected to distortion in the area where each pot and its cover contact each other, whereby it is possible to keep the pots sufficiently gastight for applications, such as aluminum brazing and heat treatment of stainless steel, brass or the like.

These and other objects, novel features and advantages of this invention will become apparent from the following detailed description and the accompanying drawings, in which.

The invention will now be described in detail with reference to a preferred embodiment thereof.

Figure 1:
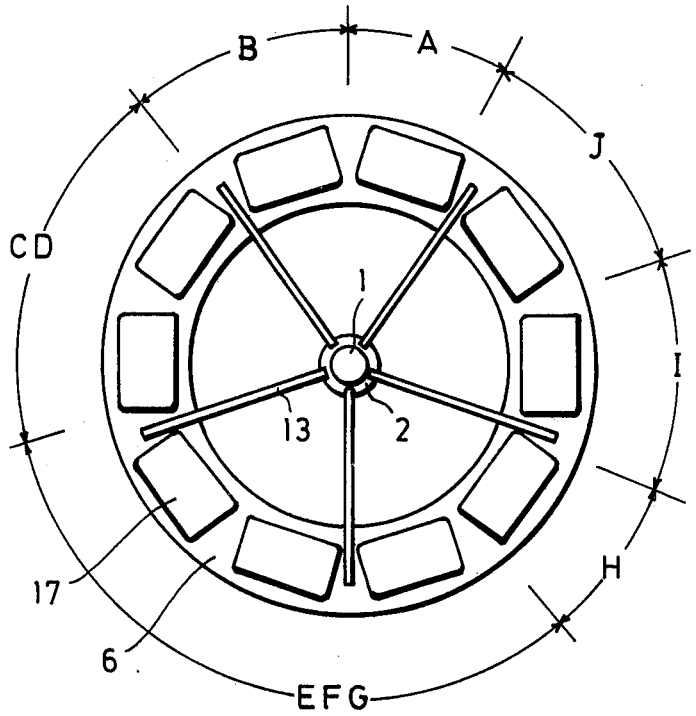
FIG. 1 is a schematic top plan view of a continuous atmosphere controlled furnace according to this invention.
Figure 2:
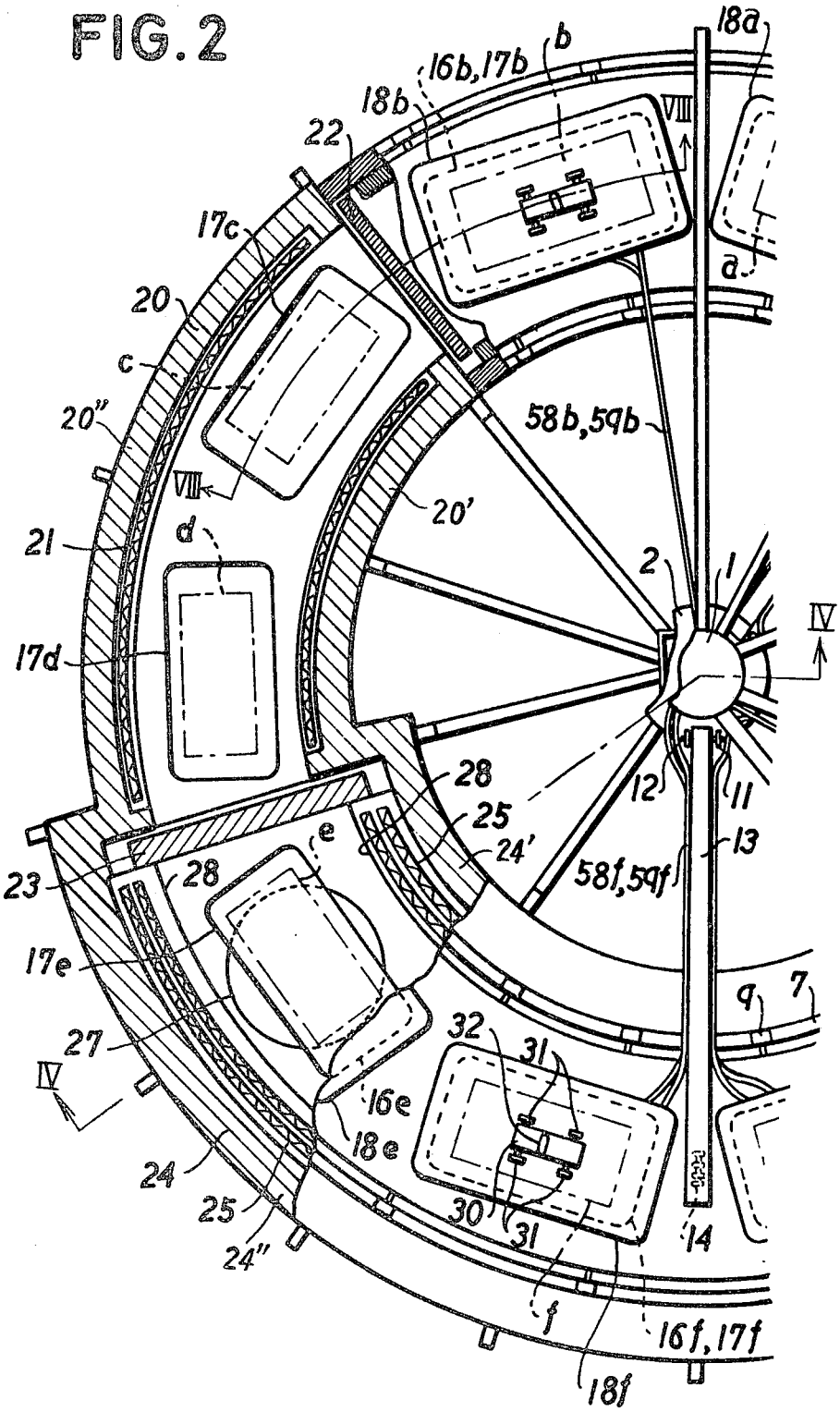
FIG. 2 is a top plan view partly in section of one half of the furnace shown in FIG. 1.
Figure 3:
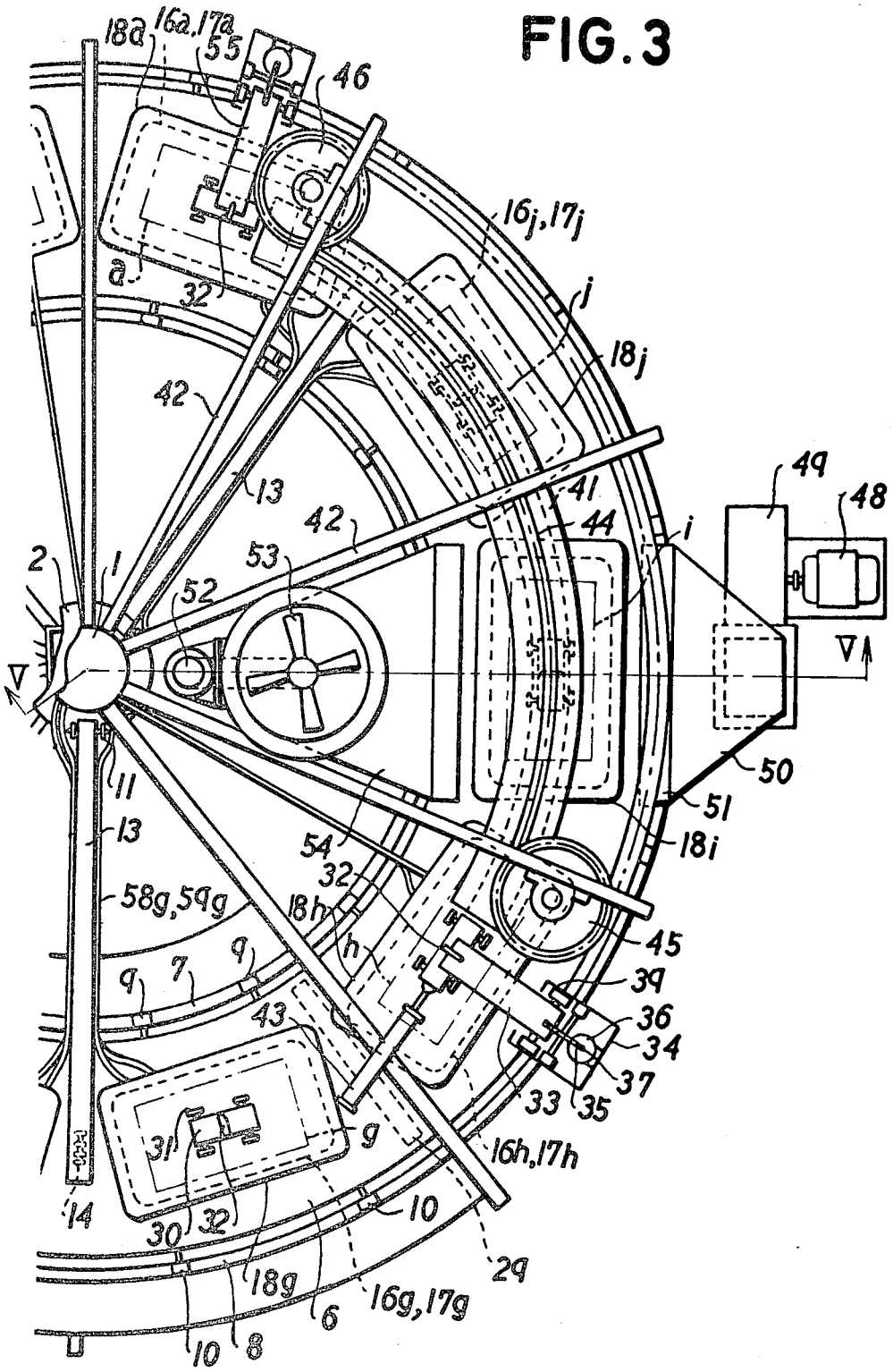
FIG. 3 is a top plan view of the other half of the furnace shown in FIG. 1.
Figure 4:
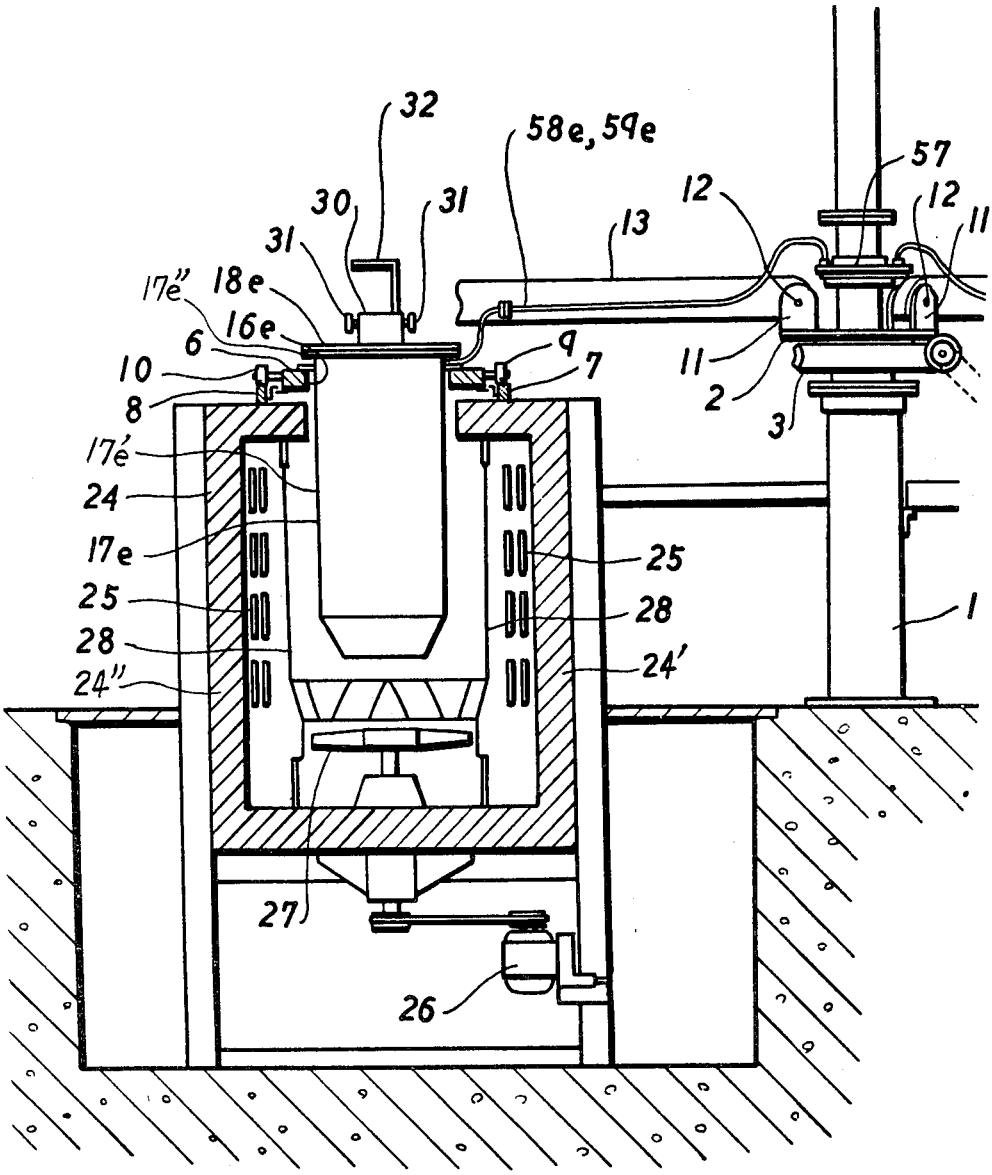
FIG. 4 is a sectional view taken along the line IV—IV of FIG. 2.

The continuous atmosphere controlled furnace of this invention comprises a charging zone A, a non-oxidizing atmosphere gas purging zone B, preheating zones C and D, heating zones E, F and G, a slow cooling zone H, a cooling zone I and a discharging zone J as shown in FIG. 1.

Referring to the drawings more particularly, the furnace is centrally provided with a supporting column 1. A rotary base 2 is rotatably supported on the column 1 by a bearing at a predetermined height above the ground. A worm wheel 3 is integrally connected to the rotary base 2. A worm 4 is supported from the column 1 and engages the worm wheel 3. The worm 4 is operationally connected by a chain to an electric motor 5 with brakes. The motor 5 rotates the rotary base 2 intermittently at a predetermined angle. An annular roof 6 is made of refractory material. The roof 6 is provided along its inner periphery with equally spaced-apart wheels 9. The outer periphery of the roof 6 is likewise provided with equally spaced-apart wheels 10. The wheels 9 and 10 are respectively placed on inner and outer rails 7 and 8, so that the roof 6 is horizontally rotatable about the column 1. The inner and outer rails 7 and 8 are supported on structural steel members 7' and 8' in the slow cooling zone H, the cooling zone I, the discharging zone J, the charging zone A and the purging zone B and on furnace walls 20', 20'', 24' and 24'' in the preheating zones C and D and the heating zones E, F and G.

A plurality of brackets 11 are provided on the rotary base 2. A driving rod 13 is pivotally connected at one end to each bracket 11 by a pin 12. The other end of the driving rod 13 is connected by a pin 15 to a bracket 14 on the roof 6. The driving rods 13 transmit rotation of the rotary base 2 to the roof 6.

The roof 6 is formed therethrough with ten equally spaced rectangular openings **16*a* through 16*j*. It is to be noted that throughout the present description, the alphabetical letters suffixed to the numerals indicating various parts denote location of those parts in the various zones of the furnace indicated by the corresponding alphabetical letters A through J. Enclosed pots 17*a* through 17*j* are of metal, such as stainless steel and have bodies 17'*a*–17'*j*, respectively, which are open at top and extend downwardly through the openings 16*a*–16*j*, respectively. Those portions of the pots 17*a*–17*j* which surround the materials a–j to be heated depend below the roof 6, but their open ends 17''*a* through 17''*j* project above the roof 6**.

Covers **18*a* through 18*j* are removably placed over the upper open ends of the bodies 17'*a*–17'*j*, respectively. The covers 18*a*–18*j* are lined with insulating material to shut off leakage of heat effectively when they are placed on the bodies 17'*a*–17'*j*. Hangers 19 depend from the underside of each cover to suspend the material a–j to be heated. Each hanger 19 is shaped in the form of shelves by vertical and horizontal supporting rods 19' and 19'', so that the materials to be heated are placed on the horizontal supporting rods 19''. Each cover has a block 30 secured to the top surface thereof and four wheels 31 are rotatably carried on vertical faces of the block 30. A hook 32 extends upwardly from the top of the block 30**.

Figure 8:
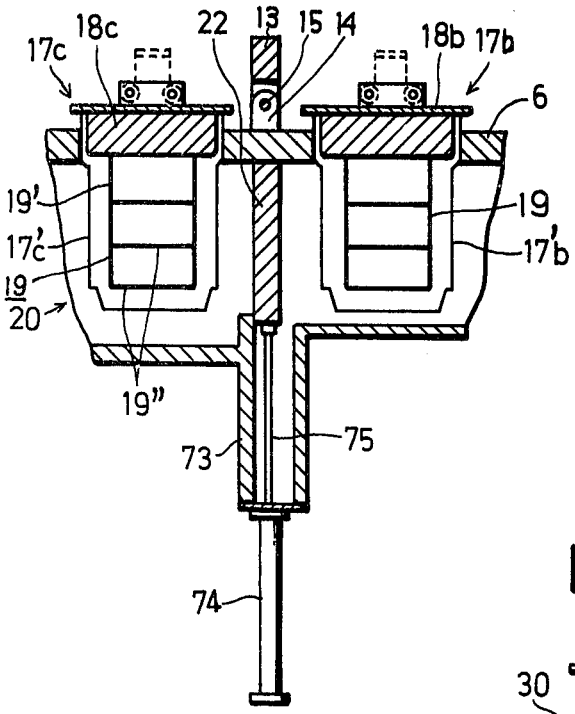
FIG. 8 is a sectional view taken along the line VIII—VIII of FIG. 2.

In the preheating zones C and D, electric resistance heating elements 21 are installed on the inner surfaces of the arcuately shaped opposite sidewalls 20' and 20'' of a preheating furnace 20. The preheating furnace 20 is provided with a door 22 at its entrance. A door operating device is connected to the door 22 as shown in FIG. 8. In FIG. 8, a door box 73 is provided under the preheating furnace 20. A door operating cylinder 74 is vertically disposed at the bottom of the door box 73. The cylinder 74 has a piston rod 75 extending upwardly into the door box 73 and having an upper end connected to the lower end of the door 22. Thus, when the piston rod 75 is retracted into the cylinder 74, the door 22 is moved away from the path of travel of the pots 17*a*–17*j* and withdrawn into the door box 73, while upon extension of the piston rod 75, the door 22 closes the entrance of the preheating furnace 20 as shown in FIG. 8.

Figure 7:
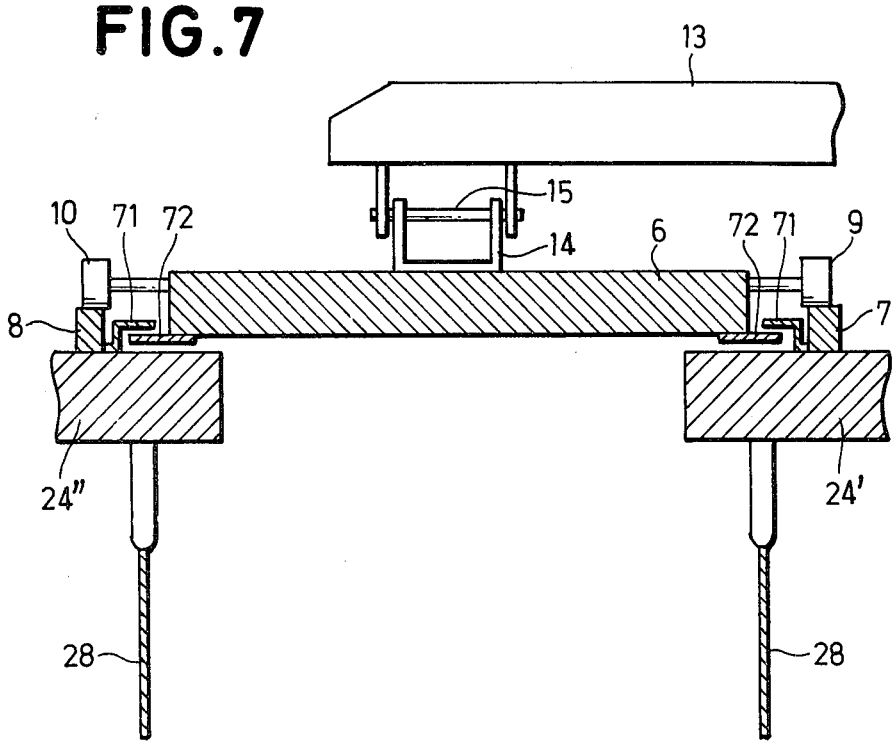
FIG. 7 is a fragmentary vertical sectional view of the furnace.
Figure 9:
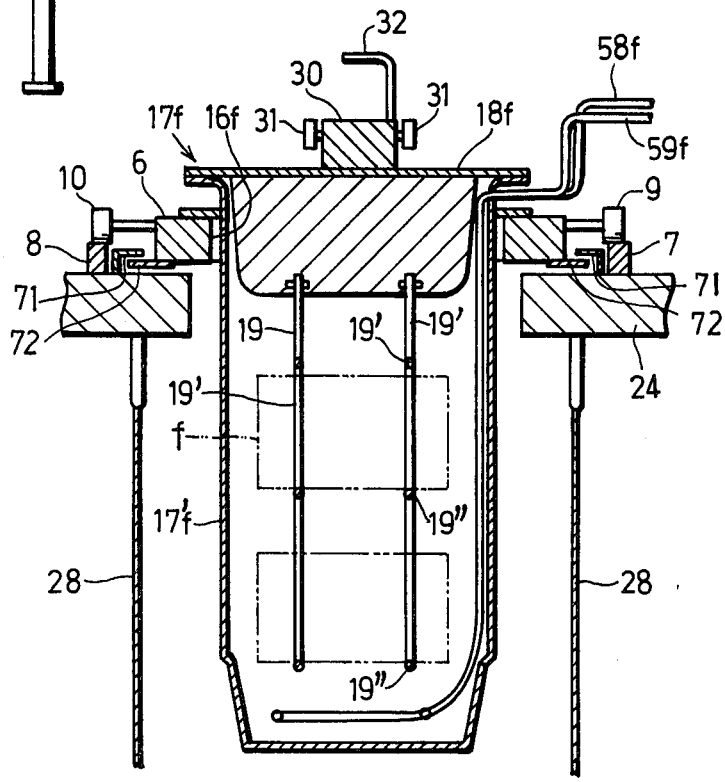
FIG. 9 is a vertical sectional view showing the relations between the roof, the pots, the material to be heated and the gas ducts.

In the heating zones E, F and G, a heating furnace 24 is arcuately constructed contiguously to the preheating furnace 20. The heating furnace 24 comprises a pair of arcuately shaped opposite sidewalls 24' and 24'' having inner surfaces along which electric resistance heating elements 25 are mounted. The heating furnace 24 is provided at its bottom with a fan 27 which is operated by an electric motor 26. A baffle 28 is provided in the furnace 24 to distribute hot air stirred by the fan 27 to contact the pots 17*e*, 17*f*, and 17*g* with the hot air effectively. The heating furnace 24 is provided with doors 23 and 29 at its entrance and exit, respectively. The doors 23 and 29 are constructed similarly to the door 22 of the preheating furnace 20 so as to open only when the pots are caused to move upon rotation of the roof 6. Sealing members 71 are secured to the top of the sidewalls 24' and 24'' and extend along the rails 7 and 8 as shown in FIGS. 7 and 9. The roof 6 is provided along its inner and outer edges with sealing members 72 interposed between the top surfaces of the sidewalls 24' and 24'' and the sealing members 71. The sealing members 71 and 72 reduce leakage of hot air from the furnace 24. Sealing members similar to the sealing members 71 are provided on the top of the preheating furnace 20.

Figure 10:
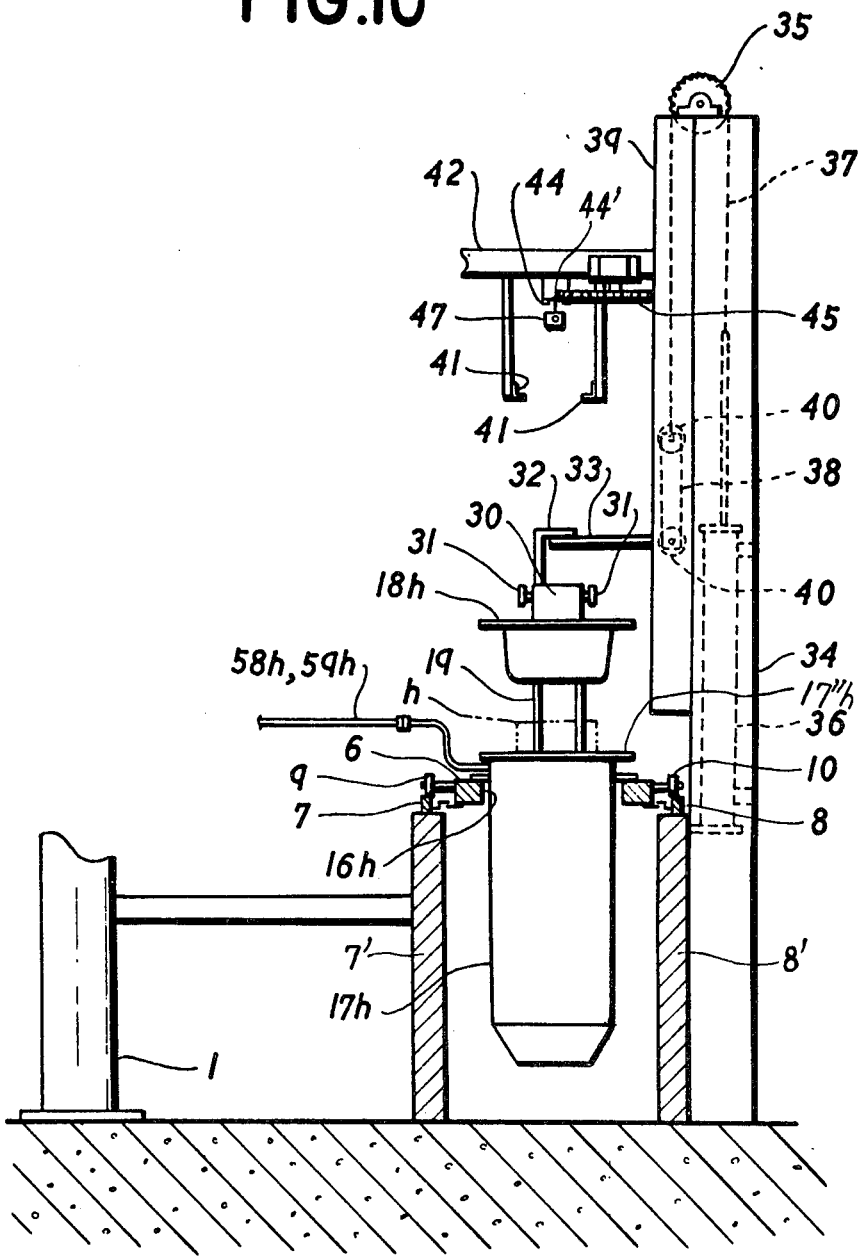
FIG. 10 is a front elevational view showing the door operating mechanism.

In the slow cooling zone H, a hydraulic cylinder 36 is secured to a column 34 as shown in FIG. 10. A chain 37 having one end fastened to the piston rod of the hydraulic cylinder 36 passes around a sprocket 35 on the upper end of the column 34. A guide column 39 is secured to the inner surface of the column 34. The guiding column 39 contains a vertically slidable lift 38 carried on wheels 40 and to which the other end of the chain 37 is connected. A lifting rod 33 is attached to the lift 38. The position of the lifting rod 33 is such that it is placed beneath the hook 32 on the cover 18*h* when the lift 38 is in its lowered position. Thus, as the lift 38 is elevated, the lifting rod 33 lifts the hook 32 to thereby suspend the cover 18*h*.

In the slow cooling zone H, the cooling zone I, the discharging zone J and the charging zone A, several beams 42 support suspension rails 41 upwardly of those zones. The spacing between the rails 41 is equal to that between the wheels 31 on the cover 18. Upwardly of the slow cooling zone H, there is provided a horizontally disposed hydraulic cylinder 43 opposite to the rails 41. The block 30 on the cover 18*h* raised by the lifting rod 33 is pushed toward the rails 41 by the hydraulic cylinder 43, whereby the wheels 31 rest on the rails 41 to suspend the cover 18*h* therefrom. Trolley conveyor rails 44 are provided above the suspension rails 41 substantially in parallel thereto. The trolley conveyor rails 44 are provided with an endless chain 44', The chain 44' passes around sprockets 45 and 46. The chain 44' is provided with a plurality of equally spaced-apart pushers 47 which are so positioned that they are opposite to the hook 32 when the wheels 31 rest on the suspension rails 41.

Figure 5:
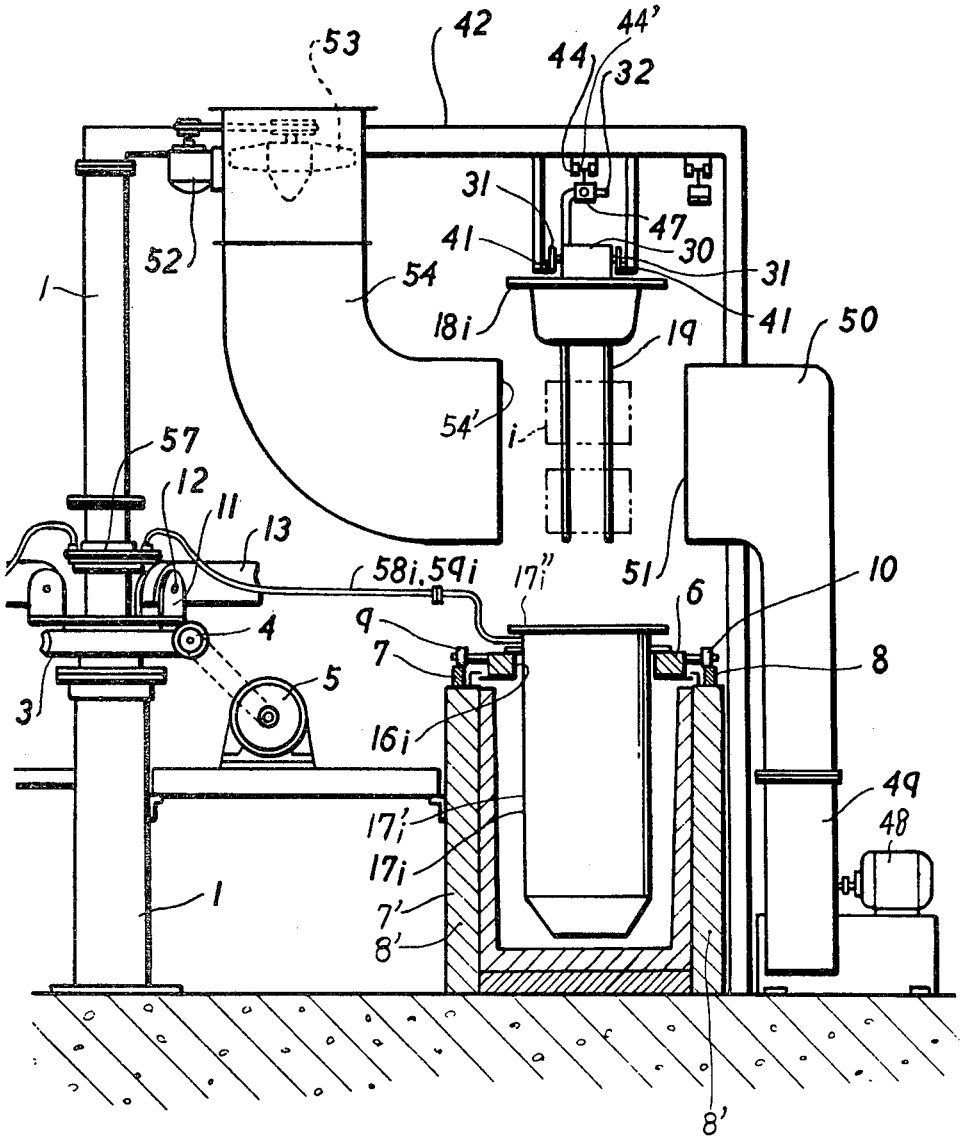
FIG. 5 is a sectional view taken along the line V—V of FIG. 3.

The cooling zone I includes a blower 49 driven by an electric motor 48. An upwardly extending duct 50 is connected to the blower 49 and has an upper outlet end 51 facing the material i to be heated when the material is suspended from the suspension rails 41 and moved horizontally. Another duct 54 has an inlet end 54' facing the outlet end 51 of the duct 50, so that the material i is interposed between the ends 51 and 54' as shown in FIG. 5. The duct 54 is supported on the beam 42 and connected to a blower 53 driven by an electric motor 52.

In the charging zone A, there is provided a lifting rod 55 which works similarly to the lifting rod 33 in the slow cooling zone H. No description is made of the mechanism for raising and lowering the lifting rod 55 which is similar to that which has been described in connection with the slow cooling zone H.

Figure 6:
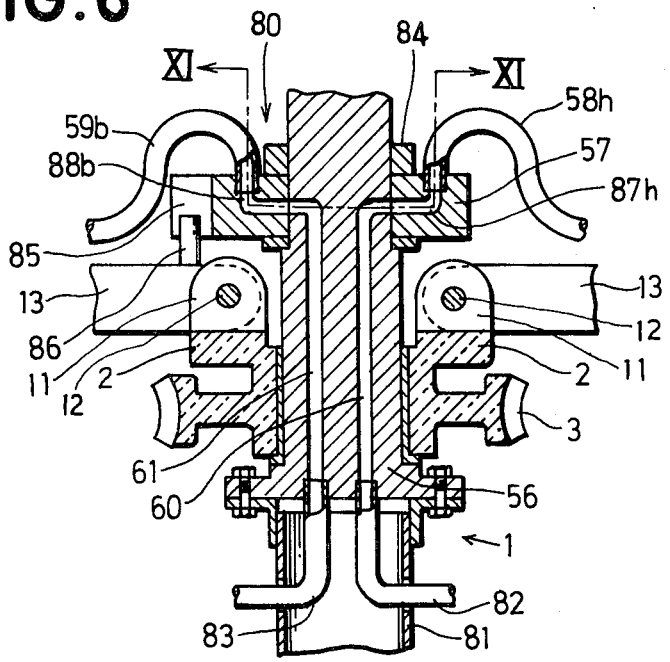
FIG. 6 is a sectional view taken along the line VI—VI of FIG. 11.
Figure 11:
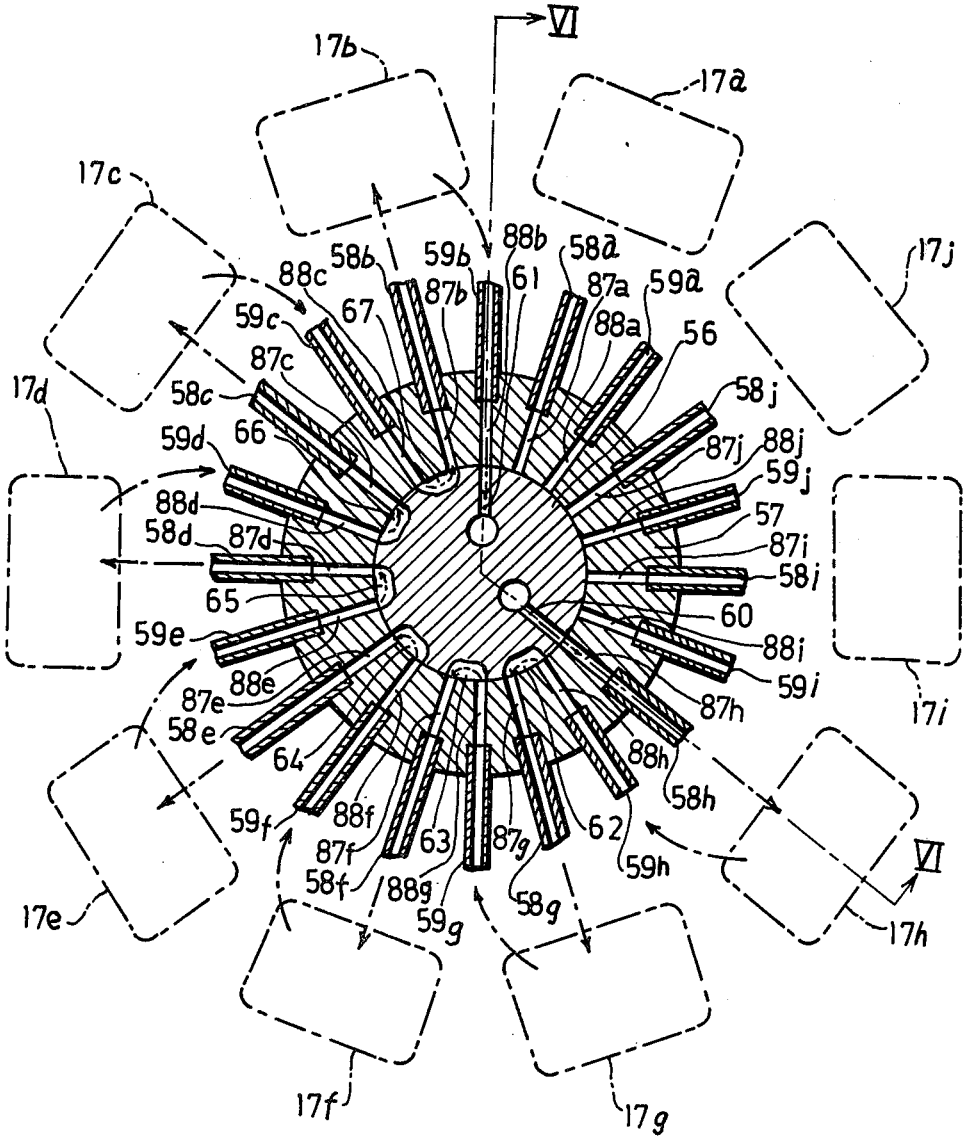
FIG. 11 is a sectional view taken along the line XI—XI; of FIG. 6.

Referring to FIGS. 6 and 11, a distributor 80 is mounted coaxially with the roof 6. The supporting column 1 comprises a lower tubular portion 81 and a central shaft 56 secured to the upper end of the tubular portion 81. The central shaft 56 is formed therethrough with a supply duct 60 and an exhaust duct 61, each of which has one end open on the peripheral surface of the central duct 56. The other end of the supply duct 60 is connected with an atmosphere gas generator by a duct 82. The other end of the exhaust duct 61 is connected to an exhaust gas disposal device by a duct 83. The outer peripheral surface of the central shaft 56 is formed with a plurality of passages 62, 63, 64, 65, 66 and 67. A central ring 57 is rotatably fitted around the central shaft 56.

A stop ring 84 is secured about the central shaft 56 to prevent axial displacement of the central ring 57. The outer periphery of the central ring 57 is formed with a recess 85 in which a connecting member 86 upstanding from the rotary base 2 is fitted. The connecting member 86 permits the central ring 57 to rotate in unison with the rotary base 2. The central ring 57 is formed with passages 87*a*–87*j* for the supply duct 60 and passages 88*a*–88*j* for the exhaust duct 61. These passages are each open at one end on the inner peripheral surface of the central ring 57 in a position facing the supply duct 60, the exhaust duct 61 and the interconnecting passages 62–67. Supply ducts 58*a*–58*j* are connected to the other ends of the passages 87*a*–87*j*, respectively, while exhaust ducts 59*a*–59*j* are connected to the other ends of the passages 88*a*–88*j*, respectively. The opposite ends of the supply ducts 58*a*–58*j* and the exhaust ducts 59*a*–59*j* extends into the pots 17*a*–17*j*, respectively, through the top of their bodies 17'*a*–17'*j*.

Referring to the operation of the distributor 80, the electric motor 5 is started to rotate the rotary base 2 and hence the central ring 57. When the pots 17*a*–17*j* stay in position, the open ends of the passages 87*a*–87*j* and 88*a*–88*j* face the open ends of the supply and exhaust ducts 60 and 61 and the interconnecting passages 62–67. The circulation of atmosphere gas is such that atmosphere gas is introduced through the supply duct 60 and supplied into the pot 17*h* in the slow cooling zone H through the passage 87*h* and the supply duct 58*h*. The atmosphere gas leaving the pot 17*h* is delivered into the pot 17*g* in the heating zone G through the exhaust duct 59*h*, the passage 88*h*, the interconnecting passage 62, the passage 87*g* and the supply duct 58*g*. In a similar manner, atmosphere gas is supplied through the pots 17*f* and 17*e* in the heating zone and the pots 17*d* and 17*c* in the preheating zone one after another. Finally, atmosphere gas is delivered into the pot 17*b* in the purging zone, in which the air in the pot 17*b* is purged with the atmosphere gas. The air and a part of atmosphere gas are discharged through the exhaust duct 59*b*, the passage 88*b* and the exhaust duct 61. The circulation of atmosphere gas as described is always effected by the distributor 80 because the central ring 57 is rotated in unison with the roof 6.

Atmosphere gas circulation in the pattern as hereinabove described contributes to improvement in the thermal efficiency of the furnace for the reason set forth below. As atmosphere gas is first supplied into the pots in the slow cooling zone, it deprives the material of heat, and after it is heated to a sufficiently high temperature in the heating zones, the atmosphere gas is circulated into the preheating and purging zones in which the atmosphere gas transfers heat to the material to be heated, so that the material can be preheated very satisfactorily.

Referring to the operation of the furnace equipment constructed as hereinabove described, the electric motor 5 is started for operation intermittently and its rotation is transmitted to the roof 6 to rotate it intermittently, whereby the pots 17 are intermittently advanced through the various zones of the furnace one after another. The brakes on the motor 5 ensure that the roof 6 correctly stop in the right place each time it is rotated. As the furnace operation proceeds, the new material to be heated is placed on the hanger 19 depending from the cover 18 in the discharging zone J. The cover 18 is then shifted along the rails 41 toward the charging zone A as the hook 32 is pushed by the pusher 47. In the charging zone A, the hook 32 is engaged with the lifting rod 55 in its raised position. Then, the lifting rod 55 is lowered to place the material to be heated into the body 17' of the pot 17, and the open top of the body 17' is closed by the cover 18. The pot 17 thus closed is moved into the purging zone B.

In the purging zone B, atmosphere gas is introduced into the pot 17 through the supply duct 58*b* to expel air from the pot 17. Then, the pot 17 is transferred to the preheating zones C and D. In the preheating zones C and D, the pot 17 is heated by the heating elements 21, so that the material in the pot 17 is heated to a predetermined temperature. The pot is, then, delivered into the heating zones E, F and G, in which the hot air which is stirred throughout the furnace by the fan 27 makes effective contact with the pots 17*e*, 17*f* and 17*g* to heat the material in the pots to a high temperature in a short time. While the materials in the pots are thus being heated, they undergo bright annealing or other intended treatment. For aluminum brazing by way of example, the material to be heated is heated in the heating zones E, F and G to a temperature of, say, about 600° C. at which solder melts, but aluminum does not. The pots are, then, moved to the slow cooling zone H in which the atmosphere gas entering through the supply duct 58*h* slowly cools the materials in the pots while the pots are stationary between the intermittent rotations of the roof 6.

In the case of aluminum brazing, for example, the material heated is allowed to cool down to a temperature below a temperature of, say, about 550° C. at which the solder solidifies. Each time the roof 6 is about to be rotated, the lifting rod 33 is raised to remove the cover 18 from the body 17' and lift the material from the pot. The hydraulic cylinder 43 is actuated to transfer the cover 8 onto the suspension rails 41. The progressively traveling pushers 47 push the hooks 32 forward to deliver the materials to the cooling zone I, in which the materials are cooled with the cool air blown out through the outlet 51 of the duct 50. Then, the materials are further moved along the suspension rails 41 into the discharging zone J, where the materials are removed from the hanger 19 and the new materials to be heated are placed on the hanger 19.

The cover 18 thus carrying the new material to be heated is moved into the charging zone A. The length of time in which the cover 18 travels from the slow cooling zone H to the charging zone A through the cooling zone I and the discharging zone J is selected to be equal to that in which the body of the pot 17 travels from the slow cooling zone H to the charging zone A by virtue of the intermittent rotation of the roof 6. Accordingly, the body 17' of one pot and its cover 18 can always be used together synchronously.

While the invention has been described with reference to a preferred embodiment thereof, it is to be understood that modifications or variations may be easily made by those skilled in the art without departing from the spirit and scope of this invention as defined by the appended claims.

What is claimed is:

1. A continuous atmosphere controlled furnace comprising:

(i) a circular roof, said circular roof having a disc-like configuration, said circular roof being rotatable in one direction in a horizontal plane, said circular roof having a plurality of openings arranged in a circle having its center on the axis of rotation of said roof, (ii) a plurality of enclosed pots, each of said pots comprising a body having an open top end and a cover capable of closing said top end, said body of each of said enclosed pots being mounted on said circular roof so as to individually block a respective one of said plurality of openings formed in said circular roof when said body is mounted on said circular roof, said open top end of said body projecting above said roof and a portion of said body to enclose material to be heated depending below said opening of said circular roof, (iii) a heating furnace located under said circular roof and surrounding an extensive portion of the path of travel of the body portion of said enclosed pots.

2. A continuous atmosphere controlled furnace as defined in claim 1, wherein a hanger for supporting said material to be heated depends from the underside of said cover.

3. A continuous atmosphere controlled furnace as defined in claim 1, wherein said furnace includes a rotary base having its axis of rotation on said axis of rotation of said roof, said rotary base being provided with a driving motor, said roof and said rotary base being connected to a driving rod.

4. A continuous atmosphere controlled furnace as defined in claim 3, wherein said furnace includes a distributor for atmosphere gas having its center on said axis of rotation of said roof and connected to said pots by supply and exhaust ducts.

5. A continuous atmosphere controlled furnace as defined in claim 4, wherein said distributor comprises a central shaft secured on said axis of rotation of said rotary base and a central ring fitted around said central shaft and rotatable in unison with said rotary base, said central ring being formed with a plurality of gas supply passages connected respectively to supply ducts and a plurality of gas exhaust passages connected respectively to exhaust ducts, each of said gas supply and exhaust passages having one end open at the inner peripheral surface of said central ring, said central shaft being formed therethrough with a gas supply duct and a gas exhaust duct, each of which has one end open at the outer peripheral surface of said central shaft, said outer peripheral surface of said central shaft being formed with a plurality of interconnecting passages, each of which interconnects one of said gas exhaust passages to which the exhaust duct leading to one of said pots is connected and one of said gas supply passages to which the supply duct leading to an immediately adjoining pot is connected.

6. A continuous atmosphere controlled furnace as defined in claim 1, wherein said furnace includes a distributor for atmosphere gas having its center on said axis of rotation of said roof and connected to said pots by supply and exhaust ducts.

7. A continuous atmosphere controlled furnace as defined in claim 6, wherein said supply and exhaust ducts extend from said open top of said each body.

8. A continuous atmosphere controlled furnace, as claimed in claim 1, wherein said covers are lined with insulating material to shut off leakage of heat effectively when they are placed on the bodies.

9. A continuous atmosphere controlled furnace having:

(i) a circular roof rotatable in one direction in a horizontal plane, (ii) a plurality of enclosed pots carried by said roof in a suspended form and arranged in a circle having a center on the axis of rotation of said roof, each of said pots comprising a body having an open top and a cover capable of closing said open top in gastight manner, said open top projecting above said roof, and that portion of each said pot which encloses the material to be heated depending below said roof, (iii) sidewalls of a heating furnace extending under said roof along a portion of the path of rotation of said roof and surrounding a portion of the path of travel of said pots, (iv) a rotary base having its axis of rotation on said axis of rotation of said roof, said rotary base being provided with a driving motor, said roof and rotary base being connected to a driving rod, (v) a distributor for atmosphere gas having its center on said axis of rotation of said roof and connected to said post by supply and exhaust ducts, said distributor comprising a central shaft secured on said axis of rotation of said rotary base and a central ring fitted around said central shaft and rotatable in unison with said rotary base, said central ring being formed with a plurality of gas supply passages connected respectively to exhaust ducts, each of said gas supply and exhaust passages having one end open at the inner peripheral surface said central ring, said central shaft being formed therethrough with a gas supply duct and a gas exhaust duct, each of which has one end open at the outer peripheral surface of said central shaft, said outer peripheral surface of said central shaft being formed with a plurality of interconnecting passages each of which interconnects one of said gas exhaust passages to which the exhaust duct leading to one of said pots is connected and one of said gas supply passages to which the supply duct leading to an immediately adjoining pot is connected.

* * * * *